US005161397A

United States Patent [19]

Raybary

[11] Patent Number: 5,161,397

[45] Date of Patent: Nov. 10, 1992

[54] KNOB CYLINDER LOCK

[75] Inventor: Paul Raybary, Roanoke, Va.

[73] Assignee: Medeco Security Locks Inc., Salem, Va.

[21] Appl. No.: 745,242

[22] Filed: Aug. 14, 1991

[51] Int. Cl.[5] ..... E05B 17/04

[52] U.S. Cl. ..... 70/374; 70/375; 70/379 R; 70/461

[58] Field of Search ..... 70/494, 379 R, 379 A, 70/374, 375, 380, 461

[56] References Cited

U.S. PATENT DOCUMENTS

| | | | |
|---|---|---|---|
| Re. 31,910 | 6/1985 | Oliver | 70/494 X |
| 883,857 | 4/1908 | Caley et al. | 70/379 R |
| 1,143,610 | 6/1915 | Carr | 70/379 R |
| 1,384,392 | 7/1921 | Laski | 70/379 R |
| 2,014,233 | 9/1935 | Keil | 70/379 R |
| 2,135,322 | 11/1938 | Brantingson | 70/379 R |
| 2,213,262 | 9/1940 | Segal | 70/379 R |
| 2,948,140 | 8/1960 | Etsten | 70/379 R |
| 3,083,561 | 4/1963 | Sussina | 70/379 R |

FOREIGN PATENT DOCUMENTS

| | | | |
|---|---|---|---|
| 66097 | 4/1943 | Norway | 70/379 R |

*Primary Examiner*—Lloyd A. Gall

[57] ABSTRACT

A retrofit knob cylinder has a cross-shaped slot on the rear of the cylinder plug and a cross-shaped opening through a plug retainer so that a number of different tail pieces may be assembled to the plug and extend through the opening and may be positioned either horizontally or vertically depending on which portion of the cross slot they are assembled in.

1 Claim, 4 Drawing Sheets

KNOB CYLINDER LOCK

BACKGROUND OF THE INVENTION

This invention relates to improvements in knobtype cylinders and particularly to improvements which allow such cylinder to be retrofit in a large number of existing applications.

BACKGROUND AND PRIOR ART

Cylindrical lock sets, dead bolts, and pad locks are in common use to lock and secure various items and are made by many different manufacturers. The cylinders in such locks may be removed and replaced and such cylinders are known as knob-type cylinders, i.e., they are quite useful in door knobs where cylinder lock sets are used. However, what are known as knob-type cylinders are also used in pad locks and tubular dead locks, as well as cylinder lock sets for door knobs. Typical replacement cylinders are available for cylinder lock sets, pad locks and tubular dead locks sold under the trademarks AMEROCK, ARROW, CORBIN, FALCON, LOCKWOOD, RUSSWIN, SARGENT, SCHLAGE, WISER, YALE for dead locks, MASTER-SYSTEM 29, MEDECO®, SARGENT & GREENLEAF, SCHLAGE 44—101 and WISER and tubular dead locks sold under the marks or names AMEROCK, ARROW, DEXTER, FALCON, SCHLAGE and WISER. Typical replacement cylinders are available to use in these constructions, however, because of the different manufacturers, different constructions, and the different positions and variety of tail pieces used with the locks, the replacement cylinders typically must correspond to the lock itself, otherwise it would not fit and hence, a large number of replacement cylinders must be stocked to meet the demand for replacement cylinders to install of locks of different manufacturers.

Quite often, lock owners desire to upgrade their cylinder lock sets, pad locks, or tubular dead locks by using high security cylinders. One manufacturer of knob-type high security cylinders is Medeco Security Locks, of Salem, Va. The MEDECO® high security locks utilize a double-locking principle as discussed U.S. Pat. No. 3,499,302 granted Mar. 10, 1970 or for even higher security with key control, use offset tumbler pin tips disclosed in U.S. Pat. No. 4,635,455 granted Jan. 13, 1987 (the BIAXIAL® lock).

There is a need in the art for a single knob cylinder which could be used as a retrofit for the knob cylinders made by many of the different manufacturers set forth above. In this way, locksmiths, distributors and the like need stock many fewer knob cylinder to affect replacement of existing knob cylinders with high security knob cylinders. Moreover, while the existing knob cylinders usually use a standard size cylinder, the problem with single retrofit is the fact that the cylinders use a wide variety of tail pieces and fix them vertically or horizontally depending on requirements. This invention allows tail pieces to be fixed either vertically or horizontally as a tail piece can be assembled in either position. There is a need to allow arrangement where tail pieces could be interchanged and assembled either horizontally and vertically to meet requirements for retrofit in a simple easy to manufacture manner.

SUMMARY OF THIS INVENTION

This invention provides a knob cylinder for use as a retrofit cylinder for a variety of cylinders on the market made by different manufacturers having a variety of tail pieces and tail piece positions. The knob cylinder of this invention has a cylinder lock plug rotatable within a bore of a lock shell when tumblers in the plug are moved by a properly bitted key to clear a shear line in the shell, the plug being held against longitudinal axial movement by a flange on the front of the plug and a plug retainer attachable to the rear of the plug, and a tail piece extending from the rear of the plug to operate a locking mechanism as is generally known in the art, with specific improvements in the form of a tail piece slot in cruciform shape in the rear of the plug, and the plug retainer also having a cruciform shape opening extending through it so that the plug retainer opening and the tail piece slot can accommodate a large variety of tail pieces positioned in various position, i.e., horizontally and vertically.

DETAILED DESCRIPTION OF THE PREFERRED EMBODIMENT

Figure 1:
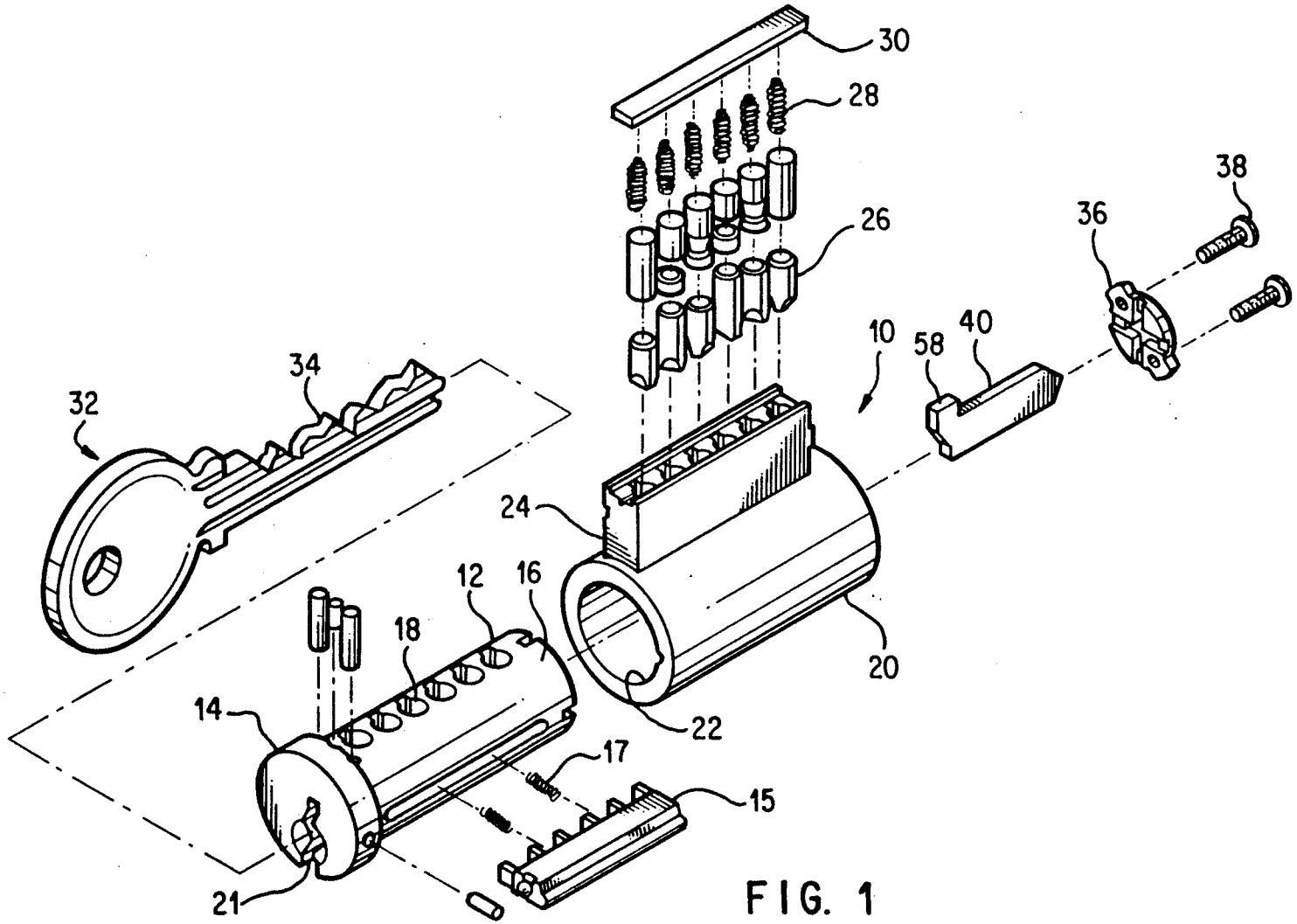
FIG. 1 is an exploded perspective view of the knob cylinder lock of this invention.

As shown in perspective in FIG. 1, a knob-type cylinder lock 10 includes a plug 12. The plug has a flanged head 14 at a front end of a plug body 16. The plug may have a side bar 15 biased by springs 17, for example, as shown in U.S. Pat. No. 3,499,302. Additionally, the plug body 16 has tumbler holes 18 and a configured keyway 21.

As is known in the art, the plug is insertable into and rotatable within a cylindrical opening 22 of a lock shell 20. The shell includes an upright housing 24 which houses a plurality of tumbler pins and followers 26 biased downwardly by springs 28 held in place by a spring cover 30 as in known in the art and shown and described in more detail, for example, in U.S. Pat. No. 3,499,302.

Operation of the lock is by means of a key 32 having properly cut bits 34 for operating the tumblers to clear a shear line around the circumference of plug body 16 and within the cylinder hole 22 as is well known in the art.

Attachable to the rear end of the plug is a plug retainer 36 which is secured by countersunk attachment screws 38. Rotatable with the plug is a tail piece 40. This tail piece can take various configurations and in this invention can be mounted either horizontally or vertically. Also, different shaped tail pieces can be used.

Figure 2:
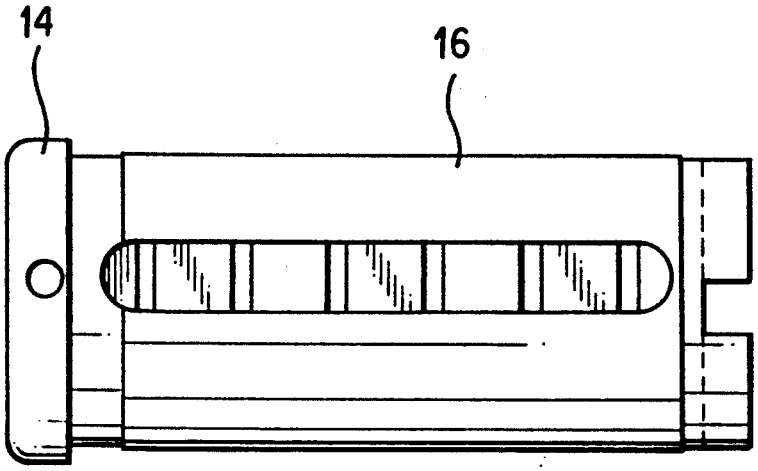
FIG. 2 is a side elevation view of the plug for the cylinder of this invention.
Figure 3:
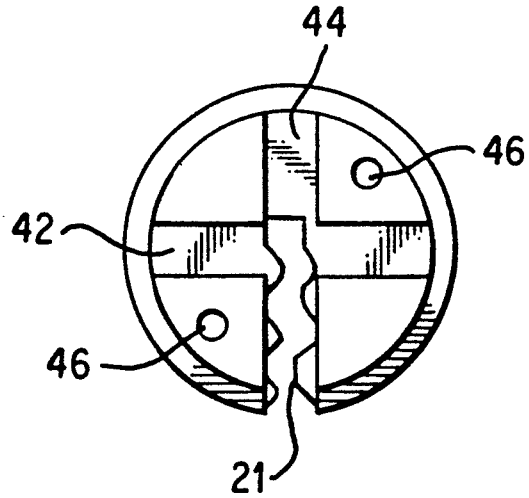
FIG. 3 is an end elevation view of the plug of FIG. 2 looking from the rear end.

As shown in FIGS. 2 and 3, the rear of the plug has slots 42 and 44 which cross to form a cross-shaped slot, a portion of the slot 44 being a keyway 21. Tapped holes 46 are provided in the end of the plug for receipt of the screws 38 to attach the plug retainer 36.

Figure 4:
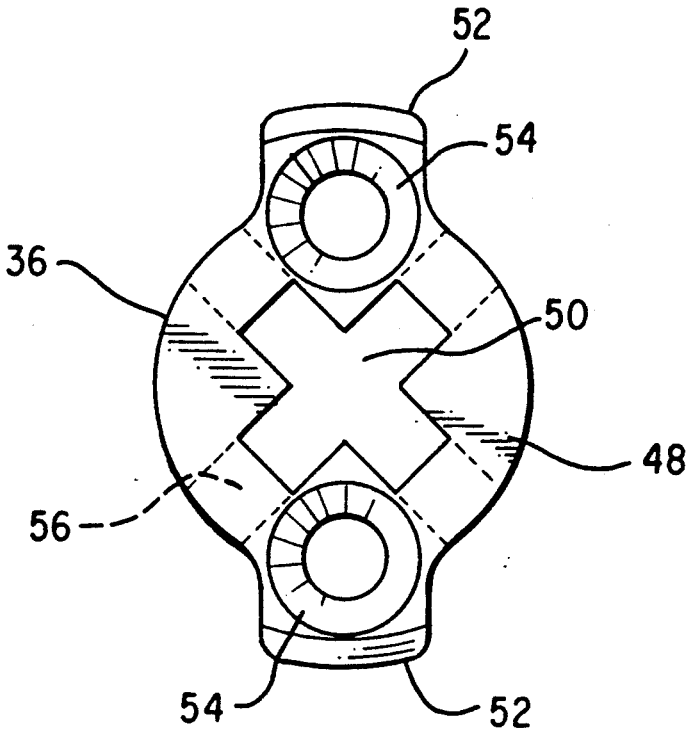
FIG. 4 is an end elevation view of a plug retainer for the knob cylinder of this invention.

The plug retainer 36 is shown in FIG. 4 and has a disk-shaped retaining body 48 with a cross-shaped opening 50 extending completely through the body from one face to the other. As can be seen in FIG. 4, the arms of the cross-shaped opening have a width which is the same as the width of slots 42 and 44 as shown in FIG. 3. Ears 52 extend from opposite sides of the retainer and contain counter sunk screw holes 54 for receipt of the screws 38 when attaching the retainer to the plug. The diameter of the ears is such that they extend over the back face of the shell 20 to retain the plug longitudinally when the plug retainer is attached to the plug. Grooves 56 in the side of the retainer adjacent the plug extend from the ends of the cross-shaped opening 50 radially outward to the edge of the disk-shaped body 48.

The tail piece 40 is illustrated in FIG. 1 has a foot 58 and is of a thickness or width slightly less than the width of the arms of the cross-shaped opening 50 and the slots 42 and 44 so as to extend through opening 50 and to be retained in cross-shaped slots 42 and 44, either horizontally or vertically as desired and depending on the mounting. Other configurations and forms of tail pieces can be used with this invention so long as they can be accommodated in the cross-shaped slot and opening.

Figure 5:
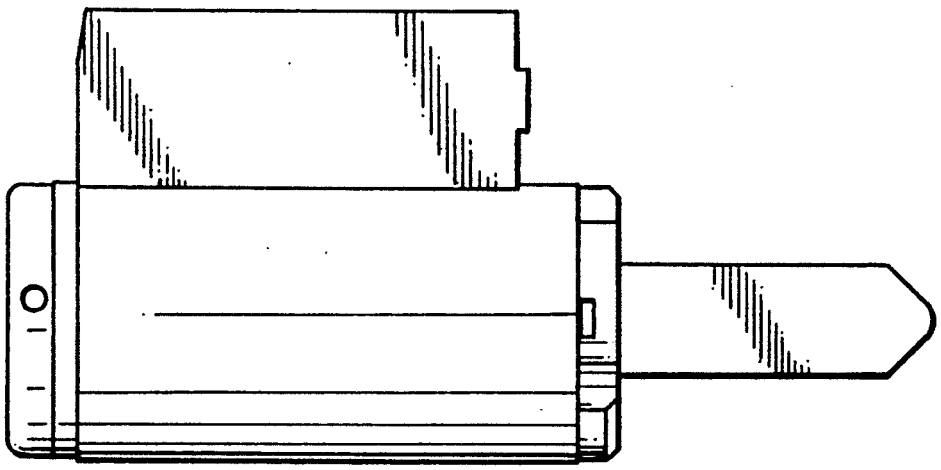
FIG. 5 is a side elevation view of the cylinder lock of this invention with a tail piece mounted in a vertical position.
Figure 6:
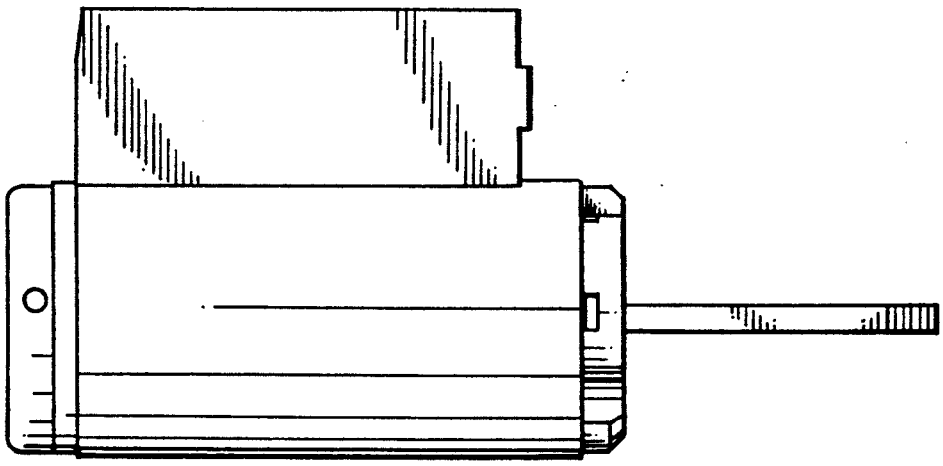
FIG. 6 is a side elevation view of a cylinder lock of this invention with a tail piece mounted in a horizontal position.

FIG. 5 shows the lock of this invention with the tail piece mounted vertically and FIG. 6 is a similar view with the tail piece mounted horizontally. The difference being due to which of the slots 42 or 44 accommodate the tail piece foot 58.

Various tail pieces are used by various manufacturers and a single retrofit cylinder as disclosed above can be used with different tail pieces being assembled either horizontally or vertically. In practice, utilizing a variety of tail pieces and positions of tail pieces, as many as 14 different applications for five different brands (Schlage, Falcon, Arrow, Yale and Master) can be used with one retrofit cylinder. Another retrofit cylinder changed only in dimensions covers six different applications of four different manufacturers (Falcon, Sargent, PDQ and Lookwood).

As can be seen, this invention discloses an improved single knob cylinder which can be used as a retrofit cylinder with a large number of applications by the unique construction and arrangements of the plug end and plug retainer.

I claim:

1. A knob cylinder lock for use as a retrofit cylinder with a variety of different applications having a variety of different tail pieces and tail piece positions, the cylinder lock having a cylinder lock plug rotatable within a bore in a lock shell when tumblers in the plug are moved by a properly bitted key to clear a shear line in the shell, the plug being held against longitudinal axial movement by a flange on the front of the plug and by a plug retainer attachable to the rear of the plug cooperating with ends of the shell, and a one-piece tail piece extending from the rear of the plug to operate a locking mechanism, with improvements comprising; a tail piece slot means in the form of a cross-shaped slot in the rear of the plug, the plug retainer attachable to the plug being disk shaped having a cross-shaped opening extending from face to face thereof so that the plug retainer cross-shaped opening and the tail piece cross slot means can accommodate a large variety of tail pieces in different positions, the plug retainer further comprises grooves for extending radially outward from the cross-shaped opening to an edge of the plug retainer in order to engage a foot of the removable tail piece, the plug retainer being disk-shaped with extending ears and further comprising screw holes in the ears for inserting screws to attach the retainer to the rear of the plug and retain a tail piece between the retainer and the plug.

* * * * *